US008075107B2

(12) United States Patent
Hatsui et al.

(10) Patent No.: US 8,075,107 B2
(45) Date of Patent: Dec. 13, 2011

(54) LIQUID EJECTION HEAD

(75) Inventors: Takuya Hatsui, Tokyo (JP); Hirokazu Komuro, Yokohama (JP); Satoshi Ibe, Yokohama (JP); Sadayoshi Sakuma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 12/484,413

(22) Filed: Jun. 15, 2009

(65) Prior Publication Data

US 2009/0315958 A1 Dec. 24, 2009

(30) Foreign Application Priority Data

Jun. 18, 2008 (JP) ..... 2008-159658

(51) Int. Cl.
*B41J 2/045* (2006.01)

(52) U.S. Cl. ..... 347/71

(58) Field of Classification Search ..... None
See application file for complete search history.

(56) References Cited

U.S. PATENT DOCUMENTS

| | | | | |
|---|---|---|---|---|
| 4,860,033 | A | 8/1989 | Shiozaki et al. | |
| 5,322,811 | A | 6/1994 | Komuro et al. | |
| 5,478,606 | A | 12/1995 | Ohkuma et al. | |
| 5,485,185 | A | 1/1996 | Sueoka et al. | |
| 5,491,505 | A | 2/1996 | Suzuki et al. | |
| 6,042,221 | A | 3/2000 | Komuro | |
| 6,084,612 | A | 7/2000 | Suzuki et al. | |
| 6,099,109 | A | 8/2000 | Komuro | |
| 6,305,080 | B1 | 10/2001 | Komuro et al. | |
| 6,390,606 | B1 | 5/2002 | Terui et al. | |
| 6,910,761 | B2 * | 6/2005 | Kondoh et al. | 347/62 |
| 7,134,742 | B2 | 11/2006 | Hatsui et al. | |
| 7,255,426 | B2 | 8/2007 | Ibe et al. | |
| 7,591,071 | B2 | 9/2009 | Ibe et al. | |
| 7,791,625 | B2 * | 9/2010 | Yamada et al. | 347/200 |
| 2007/0091147 | A1 * | 4/2007 | Koyama et al. | 347/63 |
| 2007/0120902 | A1 | 5/2007 | Ozaki et al. | |
| 2008/0094454 | A1 | 4/2008 | Koyama et al. | |
| 2009/0309933 | A1 | 12/2009 | Shibata et al. | |
| 2009/0315955 | A1 | 12/2009 | Sakuma et al. | |

FOREIGN PATENT DOCUMENTS

| | | |
|---|---|---|
| JP | 6-286149 | 10/1994 |
| JP | 11-348290 | 12/1999 |
| JP | 2005-153499 | 6/2005 |
| JP | 2005-199701 | 7/2005 |

* cited by examiner

*Primary Examiner* — Matthew Luu
*Assistant Examiner* — Erica Lin
(74) *Attorney, Agent, or Firm* — Fitzpatrick, Cella, Harper & Scinto

(57) ABSTRACT

Provided is a liquid ejection head having a structure in which an organic resinous member is formed in contact with a substrate. The substrate includes heat generators for generating heat energy used to eject ink, when being energized, and a metallic line portion for energizing the heat generators. The organic resinous member is provided with ejection openings corresponding to the heat generators. In the liquid ejection head, the substrate and the organic resinous member have an improved adhesion therebetween, and are prevented from being separated from each other. To improve the adhesion, the metallic line portion is cut so that no line portion exists under an end part of the organic resinous member (nozzle formation member). Then, two members of the line portion thus cut are connected to each other through a roundabout line formed under an insulating layer which has a good adhesion to the organic resin.

8 Claims, 10 Drawing Sheets

LIQUID EJECTION HEAD

BACKGROUND OF THE INVENTION

1. Field of the Invention

The present invention relates to a liquid ejection head that employs a scheme in which liquid is ejected by using thermal energy.

2. Description of the Related Art

Through similar processes to that for semiconductor manufacturing, a substrate for a liquid ejection head is manufactured by forming, on the same substrate, multiple heaters for heating liquid to generate bubbles when being energized, lines for providing electrical connection to the heaters, and the like. Then, a liquid ejection head is constructed in a way that a member (nozzle formation member) forming ejection openings and walls for liquid passages is provided on the substrate. Here, the ejection openings are provided corresponding to the heaters and are used to eject ink therefrom. Meanwhile, the liquid passages are formed to communicate with the corresponding ejection openings, respectively.

One method of manufacturing the liquid ejection head (see Japanese Patent Laid-Open No. H6-286149 (1994) includes the following steps:

(1) forming a pattern to form the liquid passages on the substrate with a dissolvable resin;
(2) applying a coating resin containing an epoxy resin being solid at ordinary temperature;
(3) forming openings to be the ejection openings in the coated resin; and
(4) dissolving the dissolvable resin layer.

Further, there has been proposed a liquid ejection head and a method of manufacturing a liquid ejection head in which a layer made of a polyetheramide resin (called an adhesion improvement layer below) is interposed between the substrate and the nozzle formation member in order to improve the adhesion between them (see Japanese Patent Laid-Open No. H11-348290 (1999)).

As even higher printing fineness and higher printing speed are demanded of the liquid ejection head, an increased number of heaters are required to be implemented on the substrate. This largely increases the number of lines used for energizing the heaters. As a result, depending on the locations of the heaters, the lines extending from electrode terminals of the substrate to the heaters vary in length, and accordingly greatly vary in resistance value. A possible way of evening the resistance values of the respective lines is to determine a width of each of the lines according to the distance from the electrode terminal. In this case, however, the lines for heaters existing farther from the electrode terminals have larger widths, and therefore the substrate increases in size.

To suppress the increase in the substrate size, a configuration has been proposed in which a low-resistance line common to all the heaters is formed of a thick film on the substrate surface and in which an individual line is formed from the common line to each of the heaters (see Japanese Patent Laid-Open No. 2005-153499).

To further reduce the line resistance value, the following technique has been proposed. Specifically, the common line and the electrode portions are simultaneously formed as a gold (Au) layer by plating (see Japanese Patent Laid-Open No. 2005-199701). Gold has excellent properties as a line material because of its low electric resistance, high chemical stability, high electromigration characteristics, and the like. Particularly, gold is excellent as a line material of a substrate for a liquid ejection head because the lines ordinarily exist very close to the ink and are used to energize the heaters to raise their temperature instantly.

However, the present inventors have discovered that the following technical problems needing resolution arise if the configuration using a common line as described above, especially using gold as the common line, is applied to the liquid ejection head described in Japanese Patent Laid-Open No. H6-286149 (1994) or No. H11-348290 (1999).

In the configuration of the liquid ejection head described in Japanese Patent Laid-Open No. H6-286149 (1994) or No. H11-348290 (1999), metal surfaces of the lines and the like existing on the substrate adhere to an organic resin constructing the nozzle formation member or the adhesion improvement layer. This adhesion is thought to be brought by a physical anchor effect of the organic resin entering the dips in the metal surfaces, and also by chemical bond, hydrogen bond, or the like through the OH groups existing on the metal surfaces.

However, being a stable noble metal, gold has a few OH groups on its surface, and therefore has poor bonding power with an organic resin. In addition, on a liquid ejection head substrate, the organic resin film swells because ink constantly exists near the ejection openings. Particularly, in a liquid ejection head substrate with heaters, heat generated by the heaters causes the organic resin and the substrate to expand to different degrees. As a result, the liquid ejection head substrate with heaters undergoes internal stress caused by the difference in thermal expansion between the substrate and the organic resin, in addition to the swelling of the organic resin film. This stress could possibly cause separation of the nozzle formation member from the Au layer, originating from and around parts having poor adhesion with the organic resin.

Such separation causes electrolytic ink to invade into an interface between the organic resin layer and the gold (Au) lines. Then, such ink invasion causes the electrolysis of Au and the deformation of the nozzle formation member. As a result, sufficient reliability might not be obtained.

The problems given above are especially noticeable when gold is used as the lines, but are also concerned more or less when a metal other than gold is used.

SUMMARY OF THE INVENTION

The present invention has been made in consideration of the above problems, and an objective of the present invention is to improve the reliability of a liquid ejection head by preventing the separation of a nozzle formation member made of an organic resin.

In an aspect of the present invention, there is provided a liquid ejection head having an ejection opening which ejects liquid, comprising: an element substrate provided with, on a surface thereof, an element which generates energy utilized for ejecting liquid; and a resin layer provided on the surface of the element substrate, the resin layer having a wall for a liquid passage communicated with the ejection opening, wherein the element substrate has a first electrode layer and a second electrode layer at the surface side, the first electrode layer is provided in such a manner that the first electrode layer is positioned at a portion corresponding to an end of the resin layer with respect to a direction along the surface, and the second electrode layer electrically connected to the first electrode layer is provided on an upper side of the first electrode layer in such a manner that the second electrode layer is not positioned at the portion.

In another aspect of the present invention, there is provided a liquid ejection head having an ejection opening which ejects liquid, comprising: an element substrate provided with, on a surface thereof, an element which generates energy utilized for ejecting liquid; and a resin layer provided above the surface of the element substrate, the resin layer having a wall for a liquid passage communicated with the ejection opening, wherein the element substrate has a first electrode layer and a second electrode layer at the surface side, the first electrode layer is provided in such a manner that the first electrode layer is positioned at a portion corresponding to an end of the resin layer with respect to a direction along the surface, and the second electrode layer electrically connected to the first electrode layer is provided on an upper side of the first electrode layer in such a manner that the second electrode layer is not positioned at the portion, and wherein a adhesion improvement layer is provided in such a manner that the adhesion improvement layer is positioned between the surface of the element substrate and the resin layer to be in contact with them, and is positioned at the portion corresponding to the end of the resin layer.

Incidentally, liquid mentioned herein is used in a broad sense, and indicates liquid applied to a printing medium for: forming an image, a design, a pattern, or the like; processing a printing medium; or performing processing on ink or on a printing medium.

According to the present invention, the line portion is divided into two members so that no line portion exists under an end portion of the organic resin nozzle formation member, where stress concentrates. An insulating layer having high adhesion to the organic resin is positioned under that end portion. Then, the two divided members of the line portion are connected to each other through a roundabout line positioned under the insulating layer. Accordingly, separation is prevented which originates from the end portion of the organic resin layer where stress concentrates, allowing the liquid ejection head to have improved reliability.

Further features of the present invention will become apparent from the following description of exemplary embodiments (with reference to the attached drawings).

DESCRIPTION OF THE EMBODIMENTS

The present invention will be described in detail below with reference to the drawings.

Premise of the Present Invention

Figure 7:
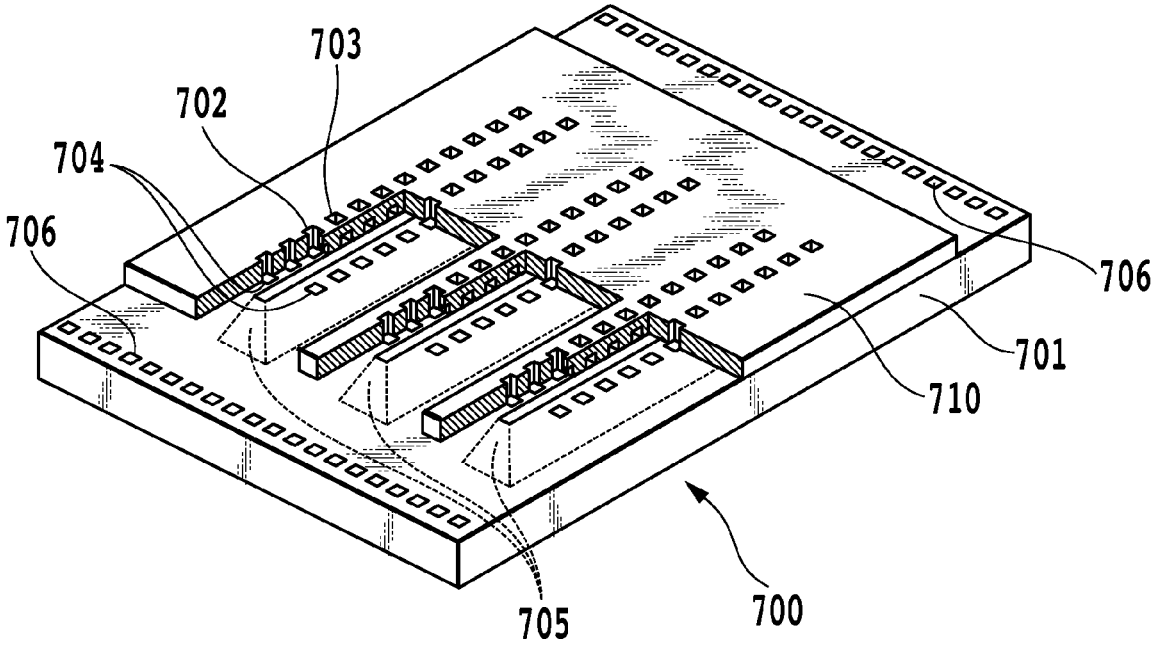
FIG. 7 is a schematic perspective view showing a typical configuration example of a liquid ejection head.

FIG. 7 is a schematic perspective view showing a general configuration example of a liquid ejection head. A substrate 701 constructed by a base plate formed of Si or the like is provided with ink supply openings 705 being slot-like through-holes, and ink is introduced into these ink supply openings. Further, two arrays of heaters 704 are formed, one on each side of each of the ink supply openings 705. Electrode portions 706 are formed along sides of the substrate 701 in a direction perpendicular to an arrangement direction of the heaters 704. The electrode portions 706 are formed to provide external electric connection to the heaters 704 for selectively energizing the heaters 704, and are connected to the heaters 704 via common lines and individual lines (neither is shown). The common lines extend in the heater arrangement direction, and each of the individual lines extends from the common lines to a corresponding one of the heaters 704. Then, a nozzle formation member 710 is formed in contact with the substrate 701. The nozzle formation member 710 is provided with liquid passages 702 and ejection openings 703 from which ink is ejected toward a printing medium by thermal energy. A liquid ejection head 700 is thus configured.

As described earlier, when the common lines are formed using Au, the nozzle formation member 710 might be separated from the substrate 701 due to poor adhesion of the common lines to a resin layer positioned thereabove.

Figure 8A:
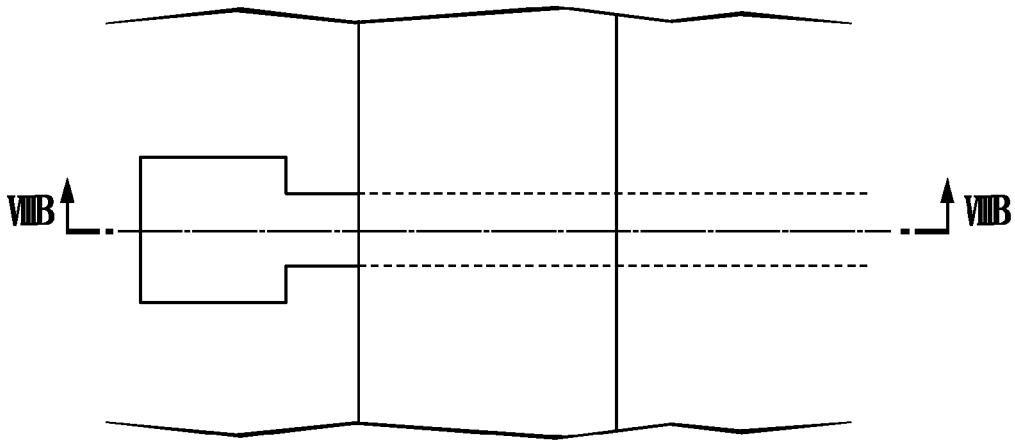
FIGS. 8A and 8B are a schematic plan view and a schematic cross-sectional view, respectively, of a main part of a liquid ejection head corresponding to a conventional technique, the liquid ejection head having been manufactured prior to embodying out the present invention.
Figure 8B:
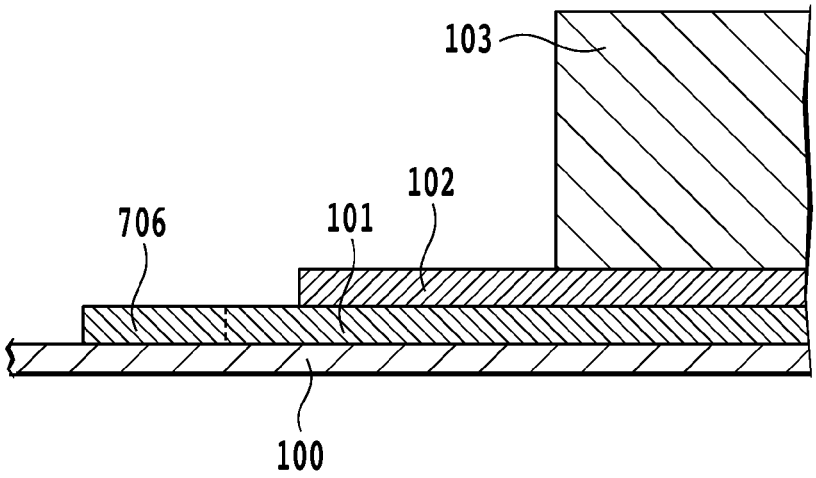
Figure 9A:
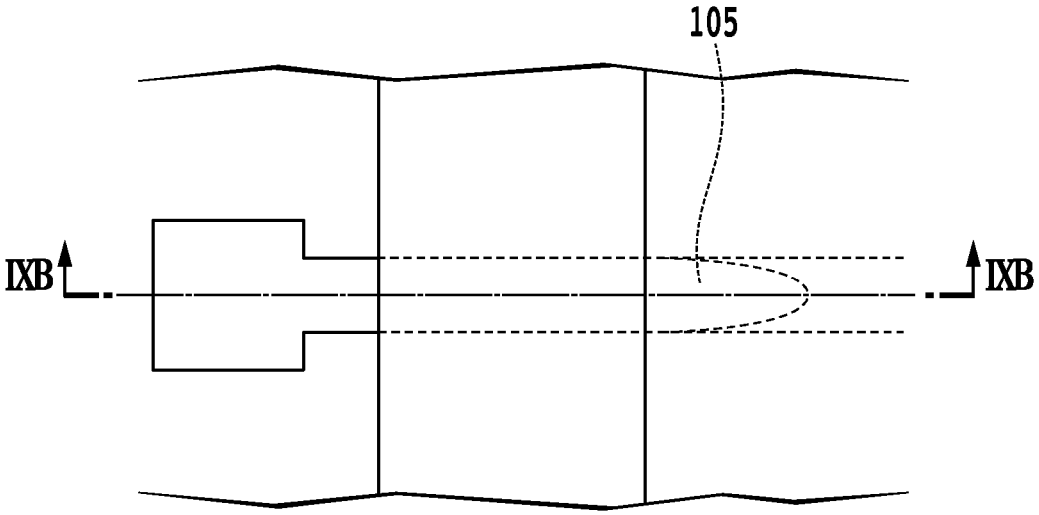
FIGS. 9A and 9B are a schematic plan view and a schematic cross-sectional view, respectively, illustrating problems caused in the liquid ejection head shown in FIGS. 6A and 6B.
Figure 9B:
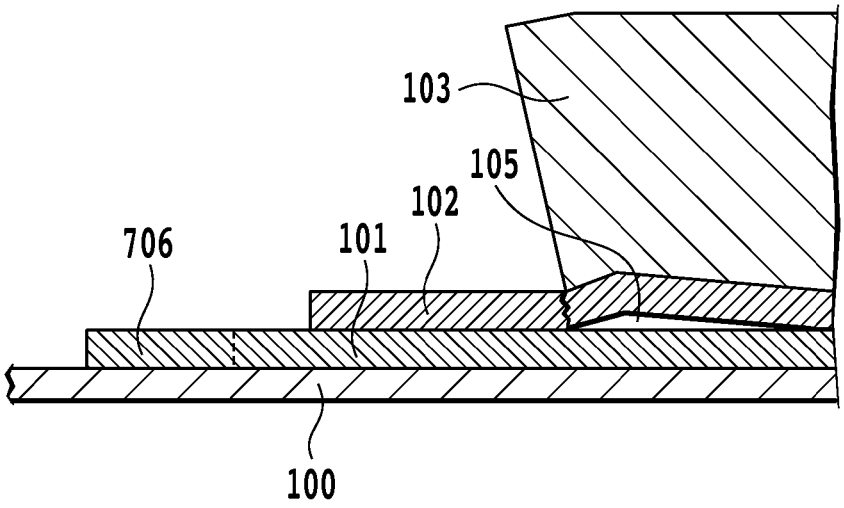

A description regarding such separation is given using FIGS. 8A and 8B and FIGS. 9A and 9B. FIGS. 8A and 9A are schematic plan views showing the vicinity of the electrode portion at an end part of the substrate 701 of the liquid ejection head 700 shown in FIG. 7. FIGS. 8B and 9B are schematic cross-sectional views taken along the VIII(b)-VIII(b) line and the IX(b)-IX(b) line viewed in the direction of the arrows in FIGS. 8A and 9A, respectively.

As shown in FIGS. 8A and 8B, the present inventors first actually formed a common line portion 101 made of Au on a layer 100 for protection and insulation provided on a surface of the substrate 701. The layer 100 will be referred to as an insulating layer. The line portion 101 can be formed simultaneously with the electrode portion 706 by plating. The electrode portion 706 is connected to a flexible printed circuit board using, for example, a tape member for tape-automated bonding (TAB), and is thereby allowed to externally give and receive electrical signals.

Further, a layer 102 and then a resin layer 103 were formed. The layer 102 is to be an adhesion improvement layer having good adhesion to the insulating layer 100. The resin layer 103 is to be the nozzle formation member 710 when the ejection openings 703 and the liquid passages 702 are formed therein. An organic resin such as an epoxy resin is used as a material for the resin layer 103.

Then, an environmental testing was performed to observe how separation occurs. As a result, as shown in FIGS. 9A and 9B, a separation 105 was observed between the layer 102 and the Au line portion 101, originating from an end part of the patterned resin layer 103. This separation 105 occurs below the layer 102 and thereby causes a crack 106 in the layer 102. This allows ink to penetrate, and causes overall lifting of the resin. Accordingly, the separation 105 become a factor of decreasing overall reliability of the substrate 701, and in turn, of the liquid ejection head 700.

It was found out that the above problem is not caused if the end part of the patterned resin layer 103, from which the separation 105 originates, is not located above the Au line portion 101. However, in the substrate for a liquid ejection head as described above, the end part of the patterned resin layer 103 is necessarily located above the Au line portion 101. This is because, in the conventional configuration, the electrode portion and a connecting portion between the electrode portion and the adjacent line portion 101 have to be exposed by forming a part without the resin layer so that power can be supplied from the outside. After being electrically connected to the flexible printed circuit board or the like, this exposed connecting portion is sealed with a sealer (not shown) to be protected from liquid (ink). At this time, sufficient space up to the end part of the resin layer 103 has to be secured in order to prevent the sealer from spreading up to the resin layer in which the ejection openings 703 are formed.

The common lines connected to the multiple heaters 704 to supply power to them have to have low resistance. In the common lines, the amount of flowing currents drastically changes depending on the number of the heaters 704 driven to eject ink. Such change in the values of the flowing currents fluctuates an amount of voltage descending due to resistance of the common lines, and consequently, fluctuates energy to be applied to the heaters 704. However, in order for the heaters 704 to eject ink stably and accurately, the energy applied to the heaters 704 has to be precisely controlled. If the resistance value of the common lines is not sufficiently small compared to those of the heaters 704, energy applied to the heaters 704 greatly fluctuates, causing unstable ink ejection. For that reason, it is desirable that the common line is formed continuously from the electrode portion 706 to the vicinity of the heaters 704.

Figure 10:
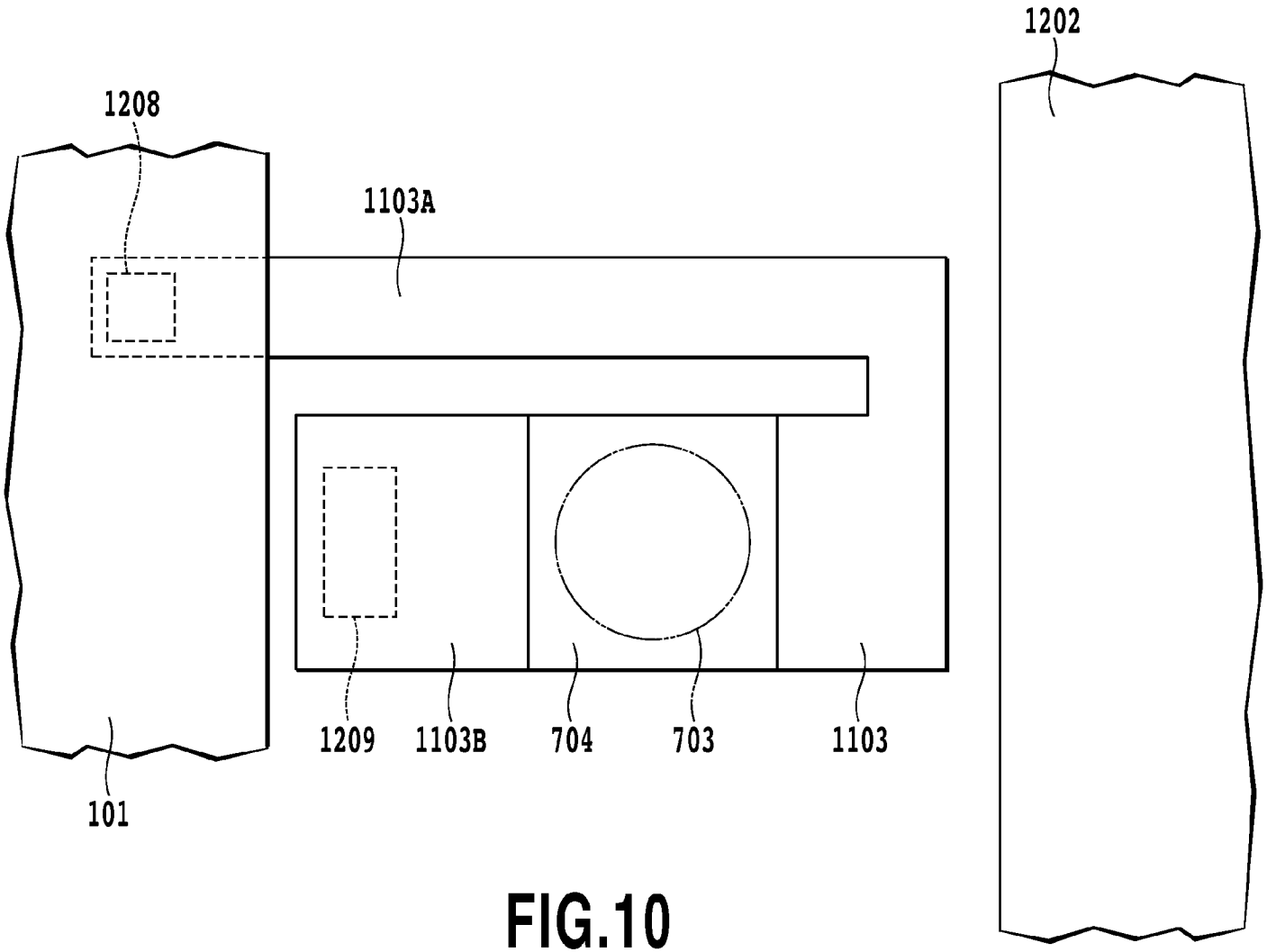
FIG. 10 is a schematic plan view illustrating how a common line and individual heater connections are connected to each other on a liquid ejection head board.

FIG. 10 is a schematic plan view showing an example of the configuration of and around the heaters 704 on the substrate 701. The multiple heaters 704 are formed on the base plate formed of Si or the like onto which a drive circuit including driving elements is built in advance. The driving element is formed of a semiconductor element such as a switching transistor, and selectively drives the heater 704. The heaters 704 are formed as follows. First, a heating resistor layer is formed on the base plate. Further, an electrode line layer is laminated, from which lines (heater lines) 1103 for the respective heaters 704 are formed. Then, these layers are subjected to desired patterning. Moreover, the electrode line layer is removed in part to expose the heating resistor layer underneath.

For example, one end of each of the heaters 704 can be connected to the line portion 101 serving as common power supply line, via one part 1103A of the heater line 1103 and then a through-hole part 1208. The other end of the heater 704 is connected to the drive circuit formed in the layer underneath, via another part 1103B of the heater line 1103 and then, for example, a through-hole part 1209. The other end of the heater 704 can be then connected to the line portion serving as common ground line.

As shown in FIG. 10, the common line are formed continuously from the vicinity of the heaters 704 to the electrode portion 706. Accordingly, this is too a reason why it is difficult not to locate the end part of the patterned resin layer 103 above the Au line portion 101.

As a countermeasure for the above problem, the present invention employs the configurations as described in the following embodiments.

First Embodiment

Figure 1A:
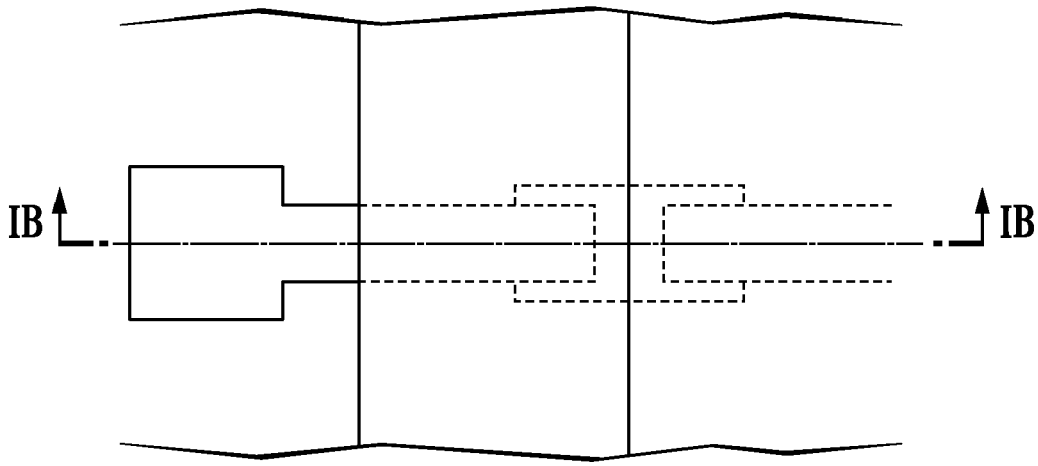
FIGS. 1A and 1B are a schematic plan view and a schematic cross-sectional view, respectively, of a main part of a liquid ejection head according to a first embodiment of the present invention.
Figure 1B:
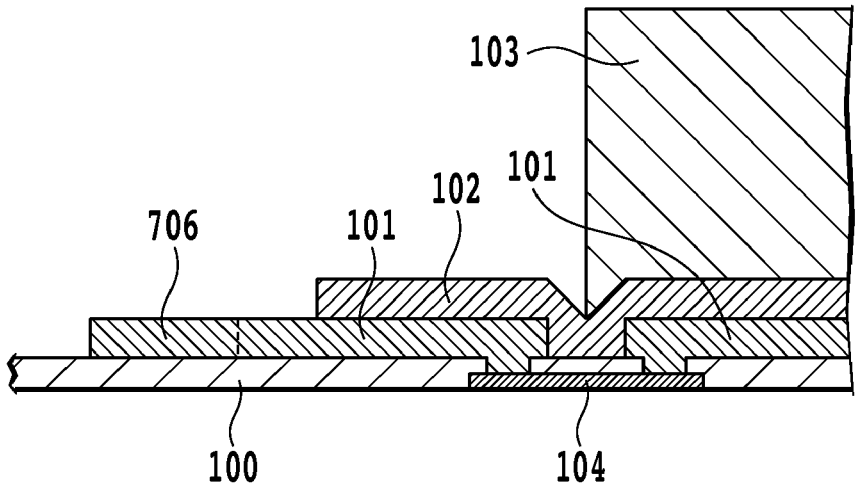

FIGS. 1A and 1B show a main part of a liquid ejection head according to a first embodiment of the present invention. FIG. 1A is a schematic plan view of the main part, and FIG. 1B is a schematic cross-sectional view taken along the I(B)-I(B) line and viewed in the direction of the arrows in FIG. 1A. Note that the relationship between part A and part B is the same in each of the figures in the embodiments described later.

First, a TaSiN layer as a material for the heaters 704 is formed on the base plate formed of Si or the like, to a thickness of 30 nm to 100 nm by a sputtering method. Subsequently to that, an Al layer to become the individual lines is formed to a thickness of 200 nm to 600 nm. In the present embodiment, the thickness of the TaSiN layer is 50 nm, and the thickness of the Al layer is 210 nm. Note that what can be used as the base plate is that onto which a drive circuit including semiconductor elements such as switching transistors for selectively driving the heaters 704, is built in advance.

Next, the TaSiN layer and the Al layer are patterned into a predetermined shape by a photolithography method. The Al layer and the TaSiN layer are simultaneously formed into a predetermined shape by dry etching. Simultaneously, a pattern for roundabout line 104 being a first electrode layer is formed with the Al layer and the TaSiN layer. The pattern is formed in the area where the Au line portion 101 is to be formed under a part at which the end part of the patterned resin layer 103 is to be, and from which the separation 105 can originate. Further, locating portions for the heaters 704 are formed by patterning the layers into a predetermined shape by the photolithography method and by performing wet etching.

Then, as an upper layer, an inorganic film (e.g., an SiN film) to become the insulating layer 100 is formed by a plasma CVD method. The insulating layer 100 is then dry-etched into a predetermined shape by the photolithography method. At this time, two through-holes are formed in the insulating layer 100 by partially removing the insulating layer 100. These through-holes are used for forming penetrating portions which connect the pattern used for the roundabout line 104 and the Au line portion 101 to each other. Here, each of the through-holes is formed with sufficient space from the end part of the patterned resin layer 103 from which the separation 105 can originate. Considering the accuracy of the photolithography method to perform alignment of the resin layer 103, it is preferable to give a distance of 10 μm or more between the two through-holes. The roundabout line 104 is formed with the Al layer and the TaSiN layer, the film thickness of which is smaller than the line part 101. Accordingly, if the two through-holes for forming the penetrating portions are separated too much, the resistance value increases. It is therefore preferable to give a distance of 30 μm or less between the through-holes. The end part of the resin layer 103 is to be positioned above the center part between the two through-holes. Accordingly, it is preferable that the end part of the resin layer 103 be positioned away from the through-holes by 5 μm or more.

Thereafter, TiW and Au films are serially formed by the sputtering method. TiW is formed as a barrier metal layer being a diffusion prevention layer. Au is formed as a seed layer to be used to grow an Au layer as the line portion 101, being a second electrode layer, by gold plating. By thus forming the Au layer, the line portion 101 is electrically connected to the roundabout line 104 through the Au penetrating portions formed in the through-holes of the insulating layer 100. After that, TiW and Au are patterned into a predetermined shape corresponding to the line portion 101 and the electrode portion 706 by the photolithography method. Further, Au is formed into a film having a thickness of 1 μm or more but not exceeding 10 μm, preferably, of 5 μm, by electrolytic plating using gold sulfite. The patterning here is performed so as to divide the line portion 101 into two members while giving space between them at a part above which the end part of the patterned resin layer 103 is to be positioned where the separation 105 can originate. These two members are electrically connected to each other through the roundabout line 104. Considering the accuracy of the photolithography method to perform alignment of the resin layer 103, it is preferable to give a distance of 10 μm or more between the two members. In addition, the two members are given a distance of 30 μm or less between them so as to be connected to the roundabout line 104 through the respective penetrating portions. The end part of the resin layer 103 is going to be positioned above the center part between the two members. Here, it is preferable that the end part of the resin layer 103 be positioned away from the parts of the line portion 101 by 5 μm or more. Thereafter, using the Au plating pattern as a mask, Au as the seed layer and TiW as the barrier metal layer are wet-etched to electrically separate the patterns from each other.

Subsequently, the nozzle formation member 710 is formed on the substrate. At this time, several μm of the layer 102 is first applied. The layer 102 is formed of a polyetheramide resin or the like which exhibits good adhesion to SiN used as the insulating layer 100. Then, the layer 102 is patterned using the photolithography method, and dry-etched into a predetermined shape. Here, for protection and insulation of the lines, the layer 102 is patterned in such a manner as to cover the lines to the vicinity of the electrode portion 706 being an electric connecting portion to the outside. An epoxy resin is used as the resin layer 103. Concrete examples of the epoxy resin may include an alicyclic epoxy resin, a bisphenol-type epoxy resin, a novolac-type epoxy resin, a glycidyl ether-type epoxy resin or the like.

Next, to form parts to be the liquid passages, a mold material is applied, and is shaped into a predetermined shape by the photolithography method. Here, to make even the height of the resin layer 103 to be applied from the top part of the mold material, patterns other than the liquid passages 702 are formed as well. An end part of the patterned mold material is to be the end part of the patterned resin layer 103 as well. Accordingly, in the above step, at a part above which the end part of the patterning is to be positioned, the Au line portion 101 is not formed, but the roundabout line 104 is formed.

Thereafter, the resin layer 103, in which the ejection openings 703 are to be formed actually, is applied to a thickness of 10 μm or more but not exceeding 100 μm, and is formed into a predetermined shape by the photolithography method. Naturally, the resin layer 103 is patterned so that its end part is positioned on the insulating layer 100 not above the Au line 101, but above the roundabout line 104. Then, the ink supply opening 705 is formed, and the mold material is removed. The liquid ejection head as shown in FIG. 7 is thus completed.

The liquid ejection head thus formed includes the substrate having a characteristic configuration.

Specifically, as shown in FIG. 1, the layer 102 is formed close to the electrode portion 706 to protect the Au line portion 101. On the other hand, the resin layer 103 thicker than the layer 102 has its end part away from the electrode portion 706. Then, the roundabout line 104 is formed under the end part of the patterned resin layer 103 where a stress concentration occurs and the separation 105 originates. The roundabout line 104 is formed with the same line layer as the one forming the individual lines. Accordingly, above the roundabout line 104, the layer 102 is in contact with the insulating layer 100, the adhesion between which is originally excellent.

As a result, the separation 105 originating from the end part of the resin layer 103 can be prevented from occurring, which in turn prevents ink invasion into the line portion 101 and lifting of the resin layer 103. Accordingly, the common line portion 101 formed of Au can be employed without impairing the reliability of the substrate and the liquid ejection head.

Note that the roundabout line 104 can also be formed of a different material and with different steps from the layer for forming the individual lines and the heaters 704.

In addition, an increase in the resistance value of the lines can be avoided by making the formation area for the roundabout line 104 as small as possible.

Figure 2A:
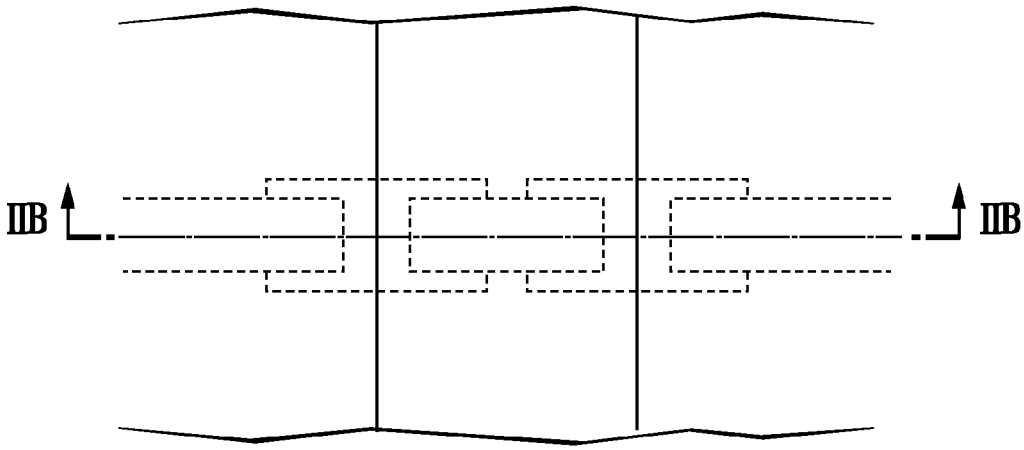
FIGS. 2A and 2B are a schematic plan view and a schematic cross-sectional view, respectively, of a main part of a liquid ejection head according to a modification of the first embodiment of the present invention.
Figure 2B:
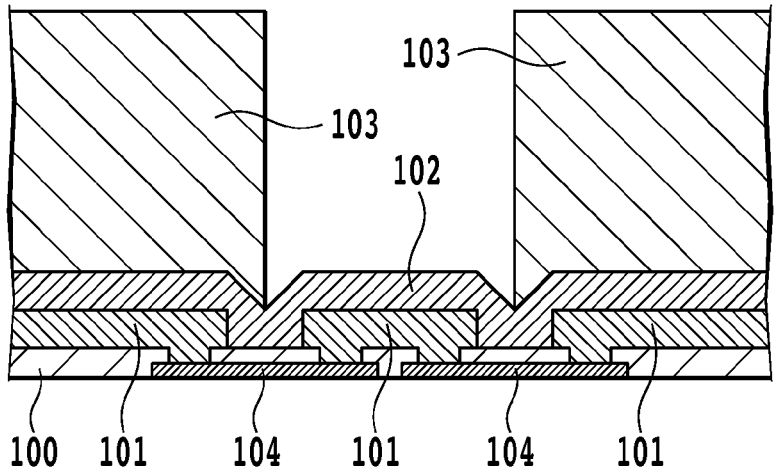

Further, the roundabout lines 104 can be formed in a manner similar to the above even when, as shown in FIGS. 2A and 2B, multiple resin layers 103 exist on the line portion 101, namely, when there are two end parts of the resin layers 103. In this case as well, an increase in the resistance value of the lines can be avoided by making the formation area for the roundabout lines 104 as small as possible.

Furthermore, although Au is used as a material for the common line 101 in the present embodiment, the configuration of the present embodiment is also effective when a different metal, for example, Ag, Cu or Ni is used as the line portion 101. Employment of the roundabout line according to the present embodiment can be effective when separation occurrence and its accompanying problems are to be avoided.

What has been described above is also true to the following embodiments.

Other Embodiments

Figure 3A:
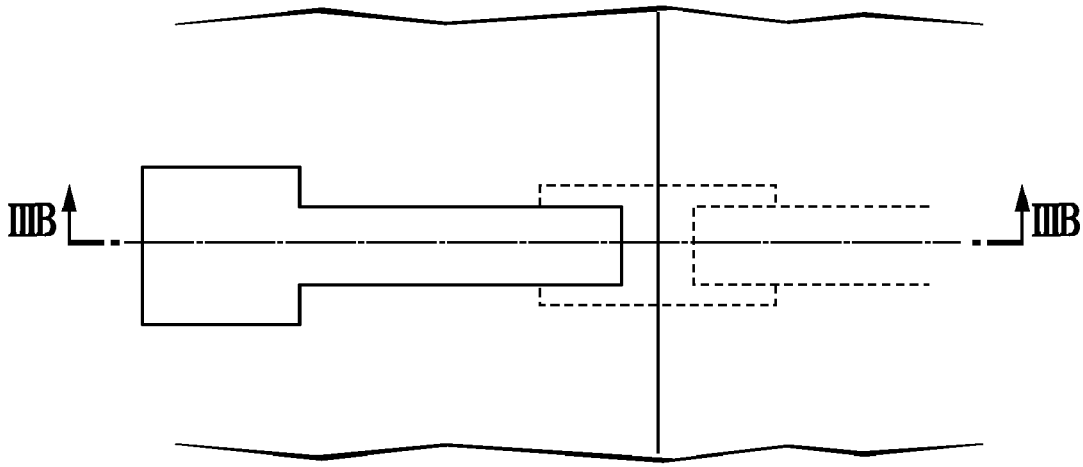
FIGS. 3A and 3B are a schematic plan view and a schematic cross-sectional view, respectively, of a main part of a liquid ejection head according to a second embodiment of the present invention.
Figure 3B:
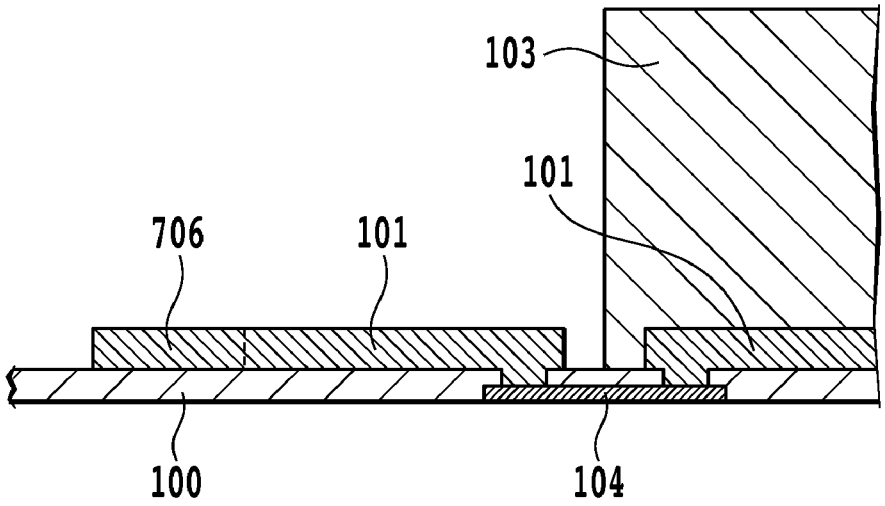

FIGS. 3A and 3B show a main part of a liquid ejection head according to a second embodiment of the present invention. The present embodiment is a configuration example different from the first embodiment in that the layer 102 is not formed. This configuration example can be adopted when there is good adhesion between the resin layer 103 and the insulation layer 100 and no need to protect the lines above which the patterned resin layer 103 is not formed.

Figure 4A:
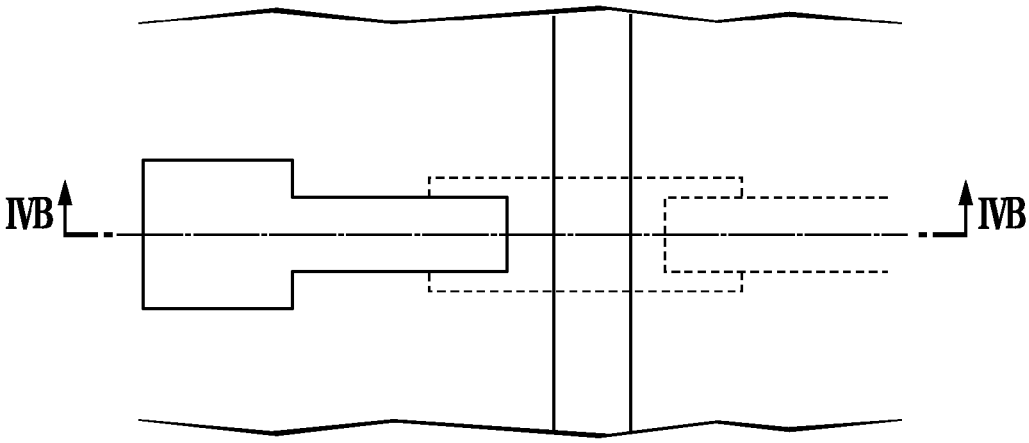
FIGS. 4A and 4B are a schematic plan view and a schematic cross-sectional view, respectively, of a main part of a liquid ejection head according to another embodiment of the present invention.
Figure 4B:
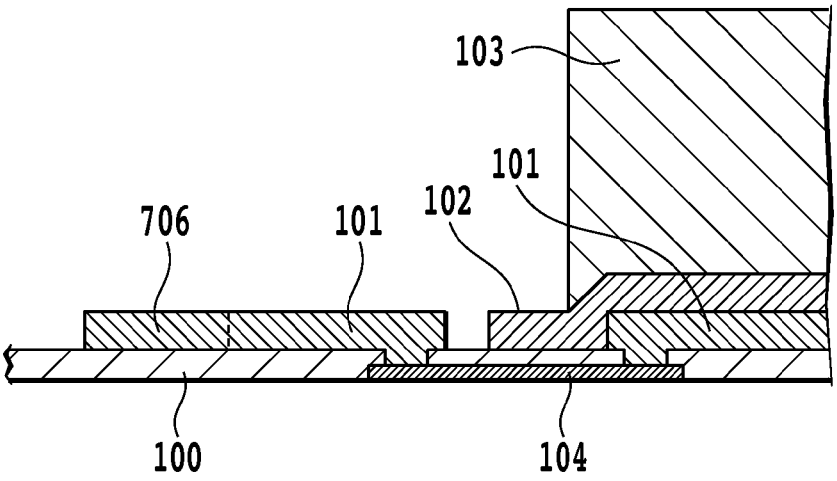

Further, as shown in FIGS. 4A and 4B, when the layer 102 is formed in such a manner that its end part is close to the end part of the resin layer 103, the roundabout line 104 may be formed under the end part of the layer 102 in a roundabout manner.

Figure 5A:
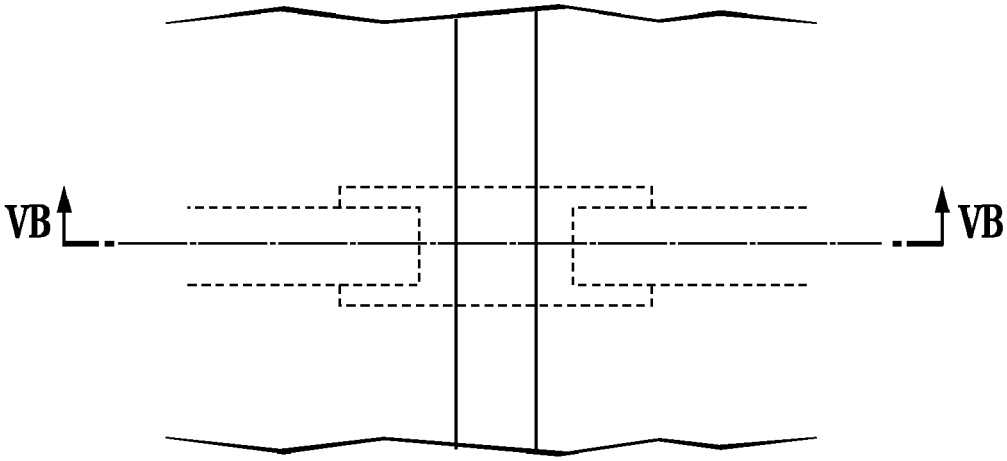
FIGS. 5A and 5B are a schematic plan view and a schematic cross-sectional view, respectively, of a main part of a liquid ejection head according to yet another embodiment of the present invention.
Figure 5B:
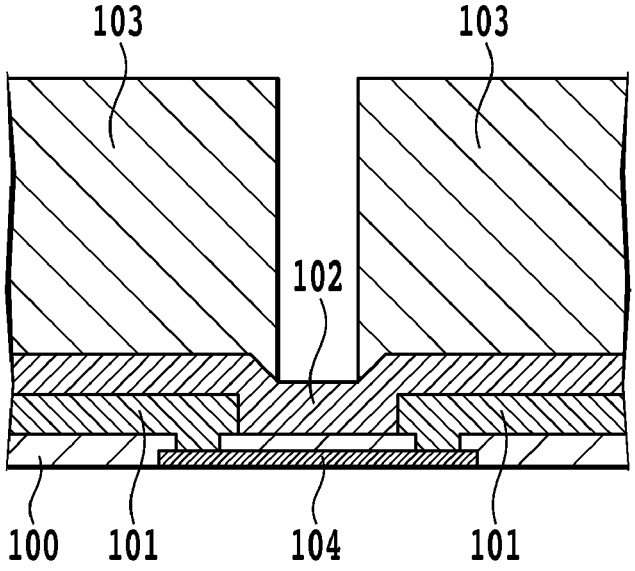

In addition, as shown in FIGS. 5A and 5B, when there are, for example, two resin layers 103 and accordingly two end parts on the line portion 101, which are close to each other, the roundabout line 104 may be formed under both of the end parts in a roundabout manner. Whether to adopt such formation of the roundabout line is selected considering the distance between the end parts and an increase to be caused in the resistance value by the roundabout line 104.

Moreover, when the layer 102 needs to be formed into a thick film, the separation 105 might be caused by the layer 102 as well. Stress occurring at the end part of the patterned layer 102 is determined based on the following factors of the resin layer 103: a film thickness, a Young's modulus and an expansion coefficient, a linear expansion coefficient, and the like upon moisture absorption.

Figure 6A:
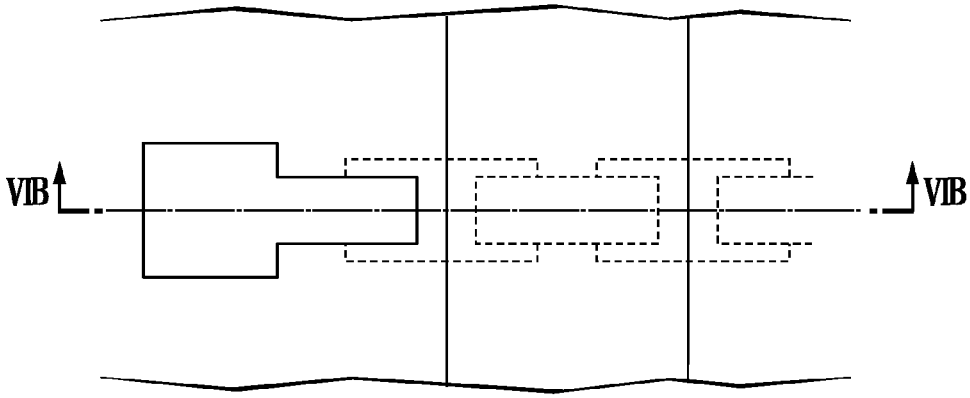
FIGS. 6A and 6B are a schematic plan view and a schematic cross-sectional view, respectively, of a main part of a liquid ejection head according to still another embodiment of the present invention.
Figure 6B:
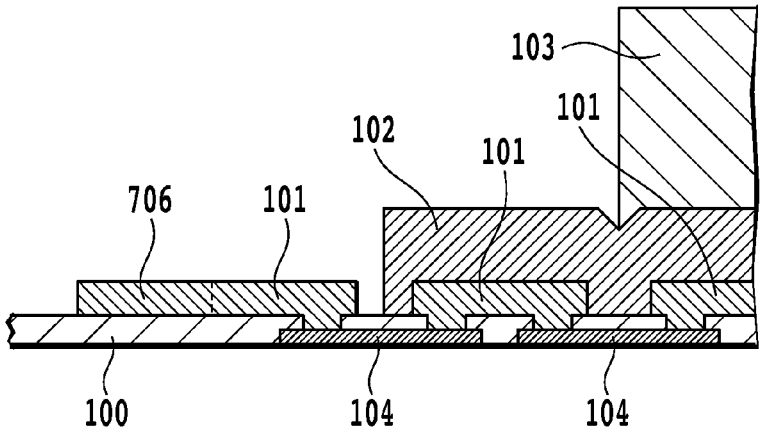

When adhesion overcoming the stress cannot be obtained, as shown in FIGS. 6A and 6B, two independent members may be formed under an end part of the patterned layer 102 and an end part of the patterned resin layer 103, respectively, by dividing the line portion 101, and the roundabout lines 104 may be formed under each of the two members.

As described above, under which pattern end part of the resin layer to divide the line portion 101 and to form the roundabout line can be selected appropriately according to various conditions. In other words, for example, when multiple layers 102, accordingly multiple end parts, exist, whether or not to divide the line portion 101 and to form the roundabout line 104 can be selected for each of the end parts. The same is true to the case where the number of the resin layer increases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-159658, filed Jun. 18, 2008, which is hereby incorporated by reference herein in its entirety.

What is claimed is:

1. A liquid ejection head having an ejection opening which ejects liquid, comprising:

an element substrate provided with, on a surface thereof, an element which generates energy utilized for ejecting liquid; and a resin layer provided on the surface of the element substrate, the resin layer having a wall for a liquid passage communicated with the ejection opening, wherein the element substrate has a first electrode layer and a second electrode layer at the surface side, the first electrode layer is provided in such a manner that the first electrode layer is positioned at a portion corresponding to an end of the resin layer with respect to a direction along the surface, and the second electrode layer electrically connected to the first electrode layer is provided on an upper side of the first electrode layer in such a manner that the second electrode layer is not positioned at the portion corresponding to the end of the resin layer, and wherein the second electrode layer is provided as two members independent of each other, each of the two members is contacted with the first electrode layer, and the two members are electrically connected with each other only through the first electrode layer.

2. A liquid ejection head as claimed in claim 1, wherein the two members of the second electrode layer are separated from each other by 10 μm or more but not exceeding 30 μm.

3. A liquid ejection head as claimed in claim 1, wherein the resin layer is formed in such a manner that the end of the resin layer is positioned in a vicinity of a center between the two members of the second electrode layer.

4. A liquid ejection head as claimed in claim 1, wherein an insulating layer having two penetrating portions is provided on the first electrode layer, and each of the two members of the second electrode layer contacts the first electrode layer through a respective one of the two penetrating portions.

5. A liquid ejection head as claimed in claim 1, wherein the second electrode layer is formed of any one of Au, Ag, Cu, and Ni.

6. A liquid ejection head having an ejection opening which ejects liquid, comprising:

an element substrate provided with, on a surface thereof, an element which generates energy utilized for ejecting liquid; and a resin layer provided above the surface of the element substrate, the resin layer having a wall for a liquid passage communicated with the ejection opening, wherein the element substrate has a first electrode layer and a second electrode layer at the surface side, the first electrode layer is provided in such a manner that the first electrode layer is positioned at a portion corresponding to an end of the resin layer with respect to a direction along the surface, and the second electrode layer electrically connected to the first electrode layer is provided on an upper side of the first electrode layer in such a manner that the second electrode layer is not positioned at the portion corresponding to the end of the resin layer, wherein an adhesion improvement layer is provided in such a manner that the adhesion improvement layer is positioned between the surface of the element substrate and the resin layer, and is positioned at the portion corresponding to the end of the resin layer, and wherein the second electrode layer is provided as two members independent of each other, each of the two members is contacted with the first electrode layer, and the two members are electrically connected with each other only through the first electrode layer.

7. A liquid ejection head as claimed in claim 6, wherein the adhesion improvement layer is formed of a polyetheramide resin.

8. A liquid ejection head as claimed in claim 1, wherein the resin layer is provided above one of the two members and is not provided above the other of the two members.

* * * * *